US006817849B1

(12) United States Patent
Taylor

(10) Patent No.: US 6,817,849 B1
(45) Date of Patent: Nov. 16, 2004

(54) SYSTEM FOR FORMING A CURB AND OTHER STRUCTURES

(75) Inventor: Edgar Taylor, Anderson, CA (US)

(73) Assignee: B. R. Lee Industries, Inc., Denver, NC (US)

( * ) Notice: Subject to any disclaimer, the term of this patent is extended or adjusted under 35 U.S.C. 154(b) by 405 days.

(21) Appl. No.: 10/010,522

(22) Filed: Dec. 5, 2001

(51) Int. Cl.[7] ..... B28B 13/02
(52) U.S. Cl. ..... 425/62; 425/64; 404/98; 404/105
(58) Field of Search ..... 425/62, 63, 64; 249/7; 404/98, 105

(56) References Cited

U.S. PATENT DOCUMENTS 3,600,773 A * 8/1971 Davis et al. ..... 425/63
3,954,359 A * 5/1976 Larkin ..... 425/63
4,014,633 A * 3/1977 Goughnour ..... 425/63
5,018,955 A * 5/1991 Parrish et al. ..... 425/64

* cited by examiner

*Primary Examiner*—James P. Mackey
*Assistant Examiner*—Donald Heckenberg
(74) *Attorney, Agent, or Firm*—Smith, Gambrell & Russell, LLP

(57) ABSTRACT

A curb or other structure is formed by a moving slip form mold receiving material used to form the structure from a hopper. The slip form mold includes two portions pivotally connected to each other. In one configuration, the slip form mold portions form a straight structure and in another configuration they are employed to form a curved structure.

9 Claims, 3 Drawing Sheets

SYSTEM FOR FORMING A CURB AND OTHER STRUCTURES

TECHNICAL FIELD

This invention relates to an apparatus for alternatively forming either a straight or a curved structure, such as a curb, on a surface utilizing a single slip form mold. The invention also encompasses a method for alternatively forming either a straight or a curved structure on a surface.

BACKGROUND OF THE INVENTION

Slip form molds are mechanisms commonly employed to form curbs or similar structures, probably the most common material utilized to form the structures being concrete. Concrete slip form molds utilized to form curbs and the like are essentially of rigid construction with the slip form mold maintaining the same configuration during operation. Typically, concrete is received by the mold from a hopper associated therewith, both the hopper and the mold being attached to a moving vehicle.

Conventional slip form molds of the type described above are highly effective when forming straight curbs or similar structures. However, they are inefficient and to a large degree ineffective in forming curved curbs or similar curved structures. The prior art slip form molds define essentially straight passageways for the material being molded. Any significant deviation of the vehicle supporting the slip form mold and associated hopper from a straight pathway along a curved path results in the side walls of the mold being required to push and reorient the curb or other structure being formed. This often results in an unsightly appearance and poor structural integrity.

DISCLOSURE OF INVENTION

The present invention relates to a system which utilizes a single slip form mold to alternatively form either straight or curved curbs or other structures on a surface.

The apparatus of the invention includes a slip form mold for connection to a moveable hopper to receive material from the hopper to form either a straight or curved structure during movement of the slip form mold.

The slip form mold defines a slip form mold interior and a slip form mold exit opening communicating with the slip form mold interior. The slip form mold includes first and second slip form mold portions pivotally connected to one another and having adjacent ends.

The second slip form mold portion has a trailing end spaced from the first slip form mold portion.

Mover means is provided for selectively pivoting the second slip form mold portion relative to the first slip form mold portion whereby the trailing end of the second slip form mold portion is laterally displaced relative to the first slip form mold portion.

The invention also encompasses a method for alternatively forming either straight or a curved structure on a surface.

The method includes the step of positioning a slip form mold having first and second mold portions over a surface.

The slip form mold is moved relative to the surface along a path of movement and during movement of the slip form mold along the path of movement, structure forming material is introduced into the first slip form mold portion to mold the material.

During movement of the slip form mold along the path of movement the material is discharged from the first slip form mold portion to the second slip form mold portion.

The second slip form mold portion is pivoted relative to the first slip form mold portion during movement of the slip form mold along the path of movement to control the shape of the structure.

Other features, advantages and objects of the present invention will become apparent with reference to the following description and accompanying drawings.

MODES FOR CARRYING OUT THE INVENTION

Figure 1:
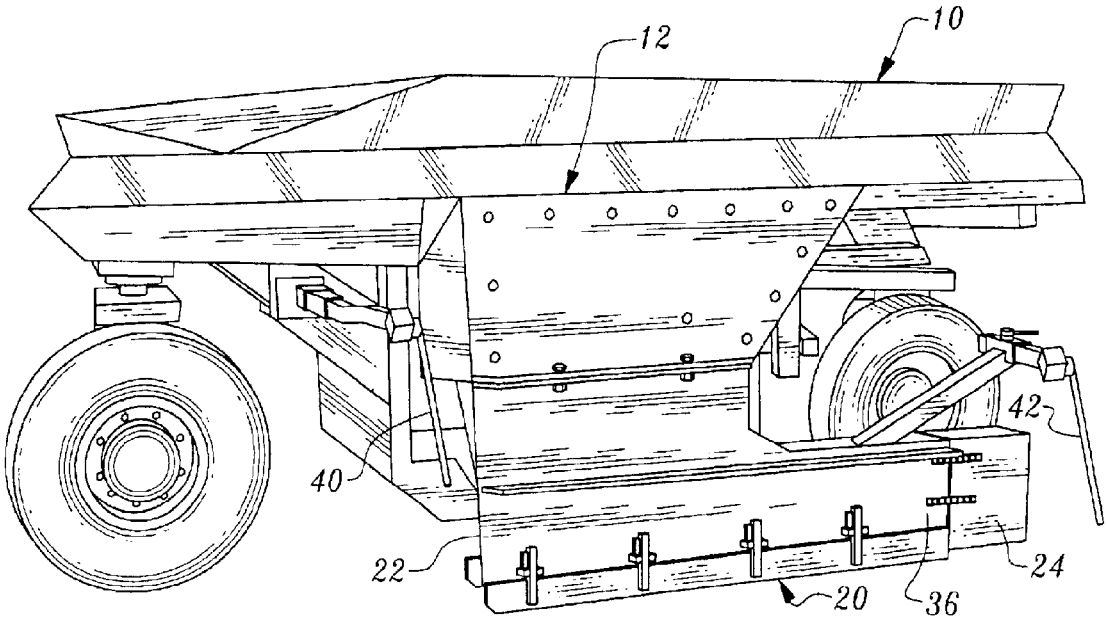
FIG. 1 is a perspective view illustrating a portion of a vehicle supporting a hopper and a preferred embodiment of a slip form mold constructed in accordance with the teachings of the present invention.
Figure 2:
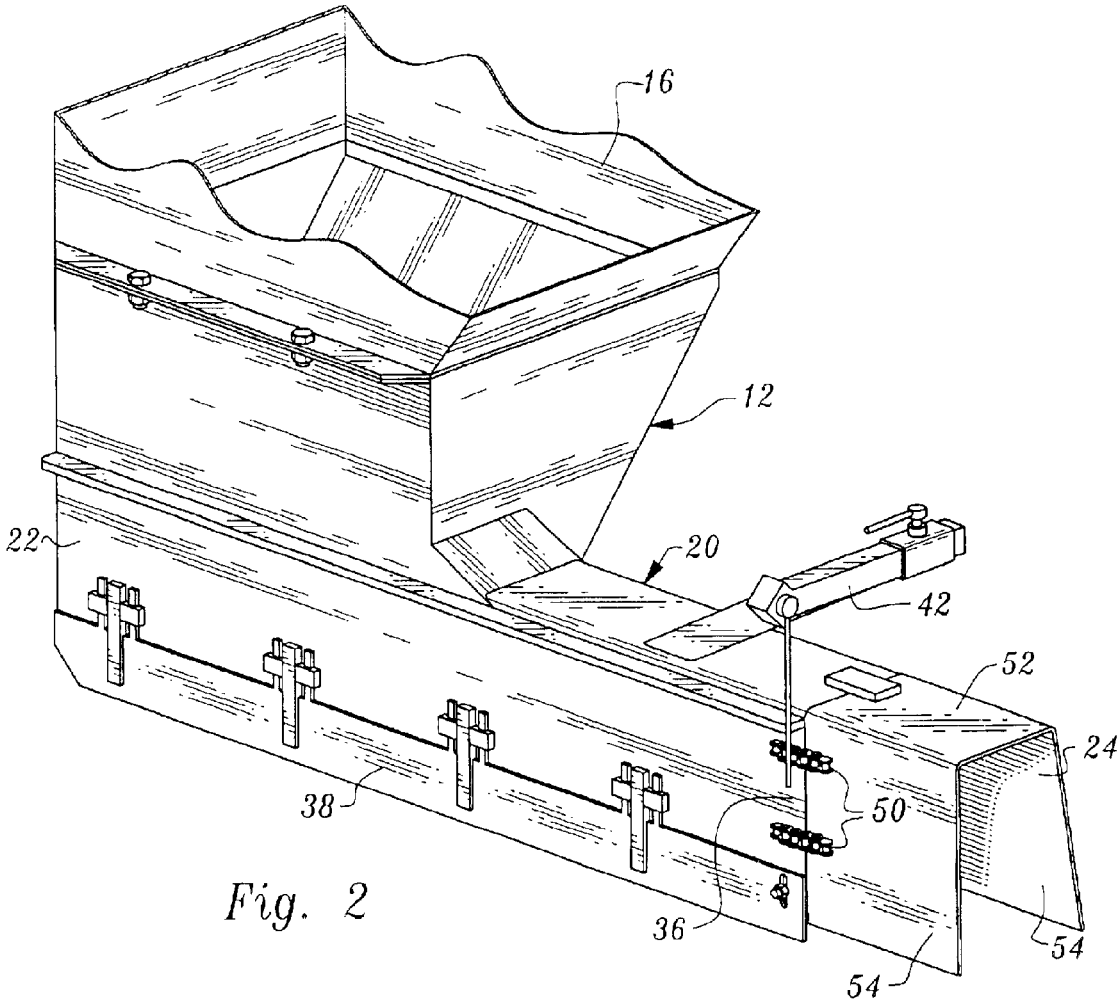
FIG. 2 is an enlarged, perspective, side view illustrating the slip form mold and a portion of the hopper to which it is connected.
Figure 3:
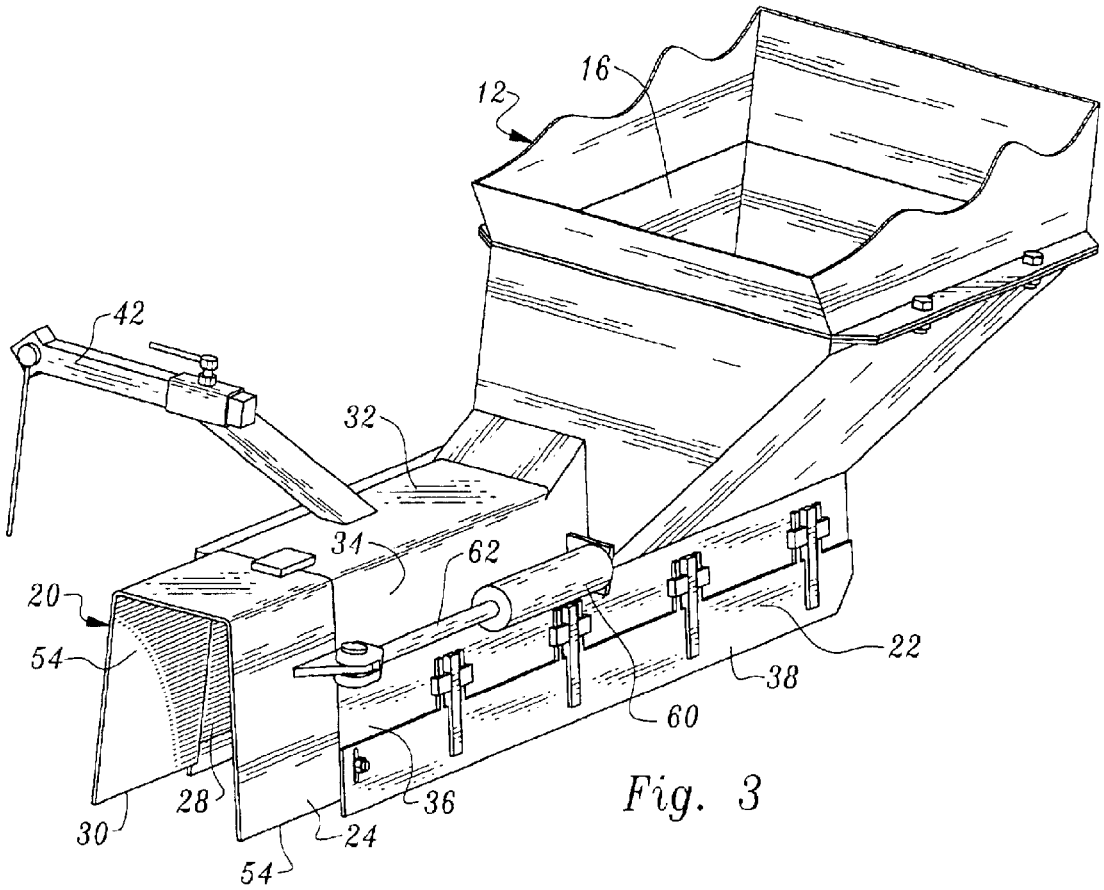
FIG. 3 is a perspective view illustrating the components shown in FIG. 2, but from the side opposed to that illustrated in FIG. 2.

Referring now to FIGS. 1–6, a portion of a wheeled vehicle 10 is shown (FIG. 1) supporting a hopper 12. Hopper 12 has a discharge opening 14 communicating with the hopper interior 16.

Attached to hopper 12 at the bottom thereof is a slip form mold 20. Slip form mold 20 includes two slip form mold portions, these portions being identified by reference numerals 22, 24, respectively. The slip form mold defines a slip form mold interior 28 and a slip form mold exit opening communicating with the slip form mold interior.

The slip form mold interior is in communication with the discharge opening 14 for receiving concrete or other material from the hopper.

The slip form mold portion 22 is of conventional construction, having a top wall 32 and side walls 34 attached to the top wall and extending downwardly therefrom. An open bottom comprising a portion of exit opening 30 is defined by side walls 34.

As is conventional, slip form mold portion 22 is of essentially rigid construction, defining a straight, inverted channel interior for receiving the concrete or other material utilized to form a curb or similar structure. The slip form mold portion 22 is rigidly attached to the hopper which in turn is rigidly attached to vehicle 10 which transports the hopper and slip form mold 20 along a path of movement. As viewed in FIG. 1, the lead end of slip form mold portion 22 is disposed on the left and the trailing end thereof, end 36, is disposed on the right.

As is conventional, the lower ends of side walls 34 may include adjustable wall portions 38. Likewise, other conventional features employed in slip mold formers may be utilized in combination with the present apparatus in a conventional manner; for example, sensors 40, 42 for sensing elevation and lateral positioning and a vibrator 48 deployed in the hopper interior to vibrate the concrete or other material therein.

Slip form mold portion 24 is pivotally connected to the trailing end 36 of slip form mold portion 22 by a pivotal connector, in this instance lengths of chain 50 secured at the ends thereof to the portions 22, 24 at only one side of the slip form mold. Thus, slip form mold portion 24 is pivotally connected to the slip form mold portion 22. The cross-sectional configuration of the slip form mold portions is virtually the same, slip form mold portion 24 including a top wall 52 and side walls 54 forming an open bottom comprising a portion of exit opening 30.

It will appreciated that the material passing through slip form mold portion 22 during movement of the slip form mold along a path of movement will be discharged into slip form mold portion 24. Slip form mold portion 24 is straight and substantially shorter than slip form mold portion 22. The lead end of the portion 24 is positioned at the trailing end 36 of portion 22.

At the side of the slip form mold 20 opposed to the side accommodating connector chains 50 is disposed a cylinder 60 affixed to hopper 12, the cylinder can be, for example, a hydraulic or pneumatic cylinder. Piston arm 62 projects from cylinder 60 and is attached at the distal end thereof to a bracket affixed to slip form mold portion 24. Alternatively, arm 62 could be solenoid operated or moved by some other means.

Figure 4:
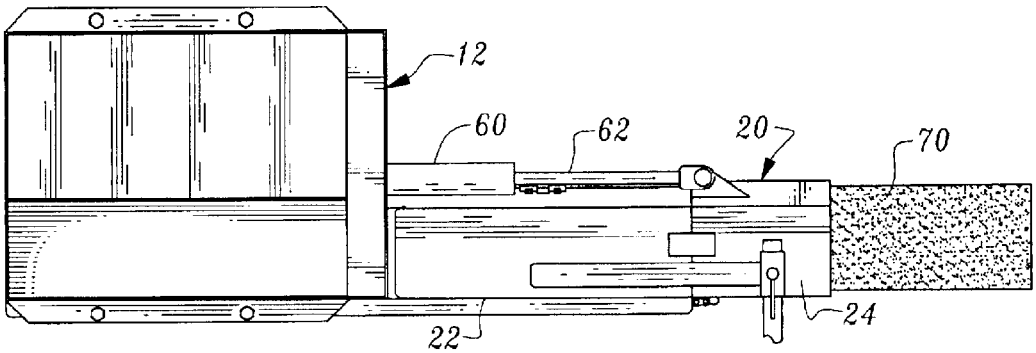
FIG. 4 is a plan view illustrating the relative positioning of the components of the apparatus when a straight curb is being formed.
Figure 5:
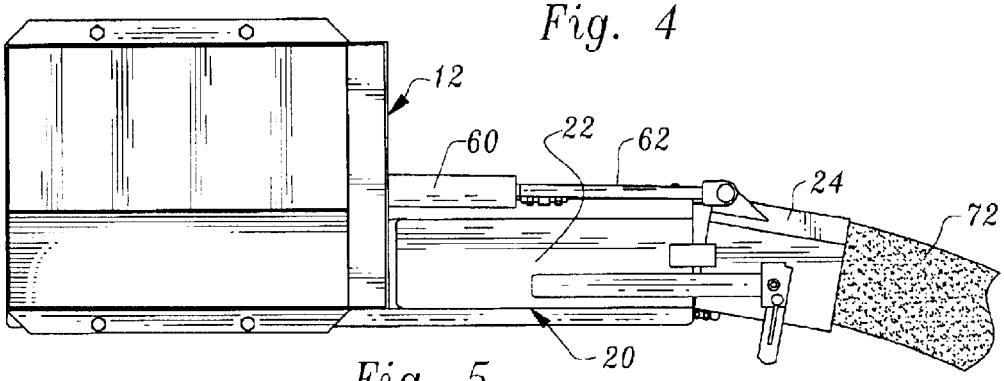
FIG. 5 is a view similar to FIG. 4, but illustrating the relative positions of the structural components when a curved curb is being formed.
Figure 6:
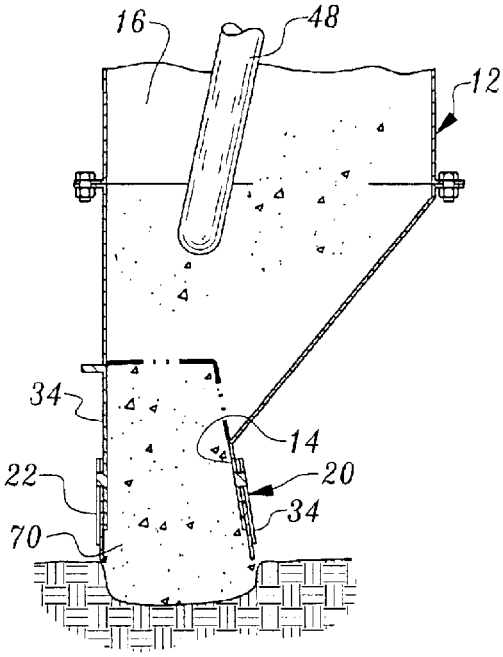
FIG. 6 is a cross-sectional view illustrating a curb being formed on a surface by the slip form mold embodiment of FIG. 1 and associated hopper portion.

When a straight section of structure such as curb 70 is being formed, the slip form mold portions 22, 24 are axially aligned as shown in FIG. 4. When, however, a curved curb section 72 is to be formed, as shown in FIG. 5, the piston arm is extended and the slip form mold portion 24 pivoted relative to slip form mold portion 22. In the FIG. 5 configuration, the trailing end of slip form mold portion 24 is laterally displaced relative to the slip form mold portion 22. Such an arrangement provides for effective and efficient formation of a curved section of curb or other structure which is of sound construction or of good appearance.

It should be noted that the open bottom of the slip form mold portion 24 is disposed higher than the open bottom of the slip form mold portion 22 in order to provide clearance facilitating pivotal movement of the slip form mold portion 24 relative to the surface on which the structure is being formed.

The invention incorporates a method for alternatively forming either a straight or a curved structure on a surface.

The method includes positioning a slip form mold having mold portions disposed over a surface and moving the slip form mold relative to the surface along a path of movement.

During movement of the slip form mold along the path of movement, material utilized to form a structure is introduced into one of the slip form mold portions to mold the material. During continued movement of the slip form mold along the path of movement, the material is discharged from that slip form mold portion into the other, downstream slip form mold portion.

The downstream slip form mold portion is pivoted relative to the upstream slip form mold portion during movement of the slip form mold along the path of movement to control the shape of the structure.

The shape of the structure can be changed at will between a curved shape and a straight shape during movement of the slip form mold along the path of movement.

Figure 7:
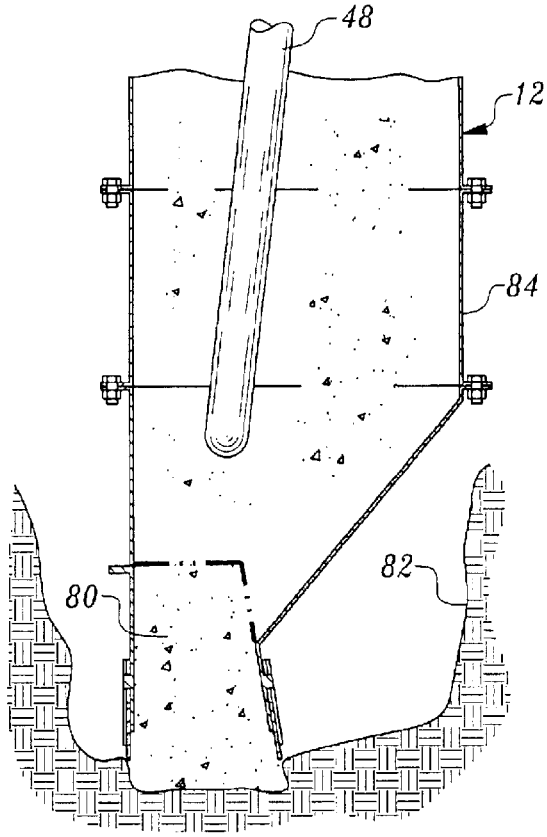
FIG. 7 is a view similar to FIG. 6, but illustrating an alternative embodiment of the invention.

FIG. 7 illustrates an embodiment of the invention wherein a curb 80 is being formed on a surface located at the bottom of a trench 82. In this embodiment, an extension 84 has been added to the bottom of hopper 12 to position slip form mold 20 at the proper location relative to the surface.

Figure 8:
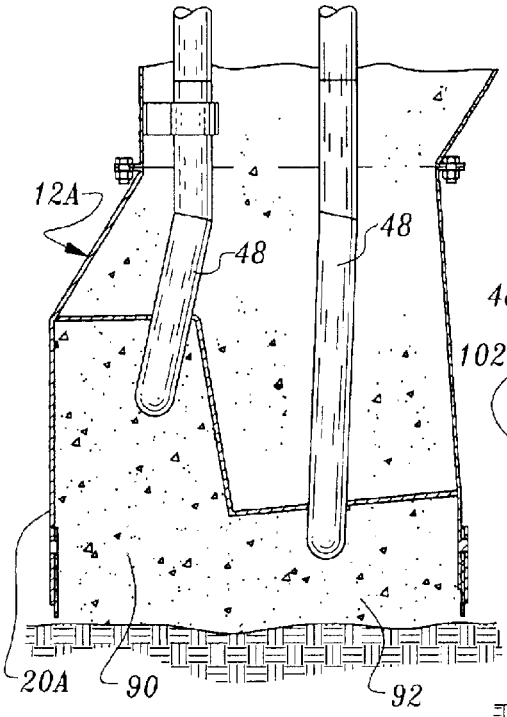
FIGS. 8 and 9 are views similar to FIGS. 6 and 7, but respectively illustrating third and fourth embodiments of the invention.

FIG. 8 illustrates another alternative embodiment wherein a slip form mold 20A is configured to form a curb 90 with an enlarged base forming a gutter 92. In this embodiment the side walls of the hopper 12A extend to the subgrade surface upon which the curb is to be formed. Slip form mold 20A extends outwardly from the trailing end wall of the hopper and defines an interior in communication with the interior of the hopper 12A for receiving concrete therefrom. Movement of the hopper and slip form mold along the ground will result in molding in situ of the curb having the configuration of the slip form mold. This approach has the advantage of supporting the weight of the concrete on the ground rather than by the machine. In this arrangement two vibrators 48 are employed.

Figure 9:
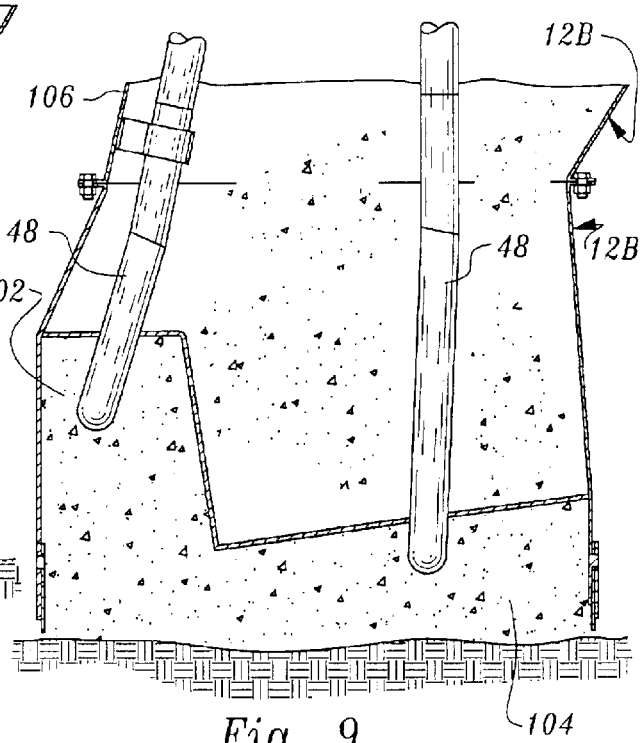

The FIG. 9 embodiment is similar to that of FIG. 8 except that the arrangement is for forming a combined curb 102 and gutter 104 wider than that of FIG. 8. The hopper 12B includes a tapered plate 106.

What is claimed is:

1. Apparatus for alternatively forming either a straight or a curved structure on a surface, said apparatus comprising, in combination:

a vehicle including a hopper defining a hopper interior for accommodating material to be formed into a curved structure, said hopper having a discharge opening communicating with said hopper interior;

a slip form mold connected to said hopper defining a slip form mold interior and a slip form mold exit opening communicating with said slip form mold interior, said slip form mold interior being in communication with said discharge opening for receiving said material from said hopper, said slip form mold including pivotally connected first and second slip form mold portions; and mover means operatively associated with said second slip form mold portion to pivotally move said second slip form mold portion relative to said first slip form mold portion.

2. Apparatus for alternatively forming either a straight or a curved structure on a surface, said apparatus comprising, in combination:

a vehicle including a hopper defining a hopper interior for accommodating material to be formed into a curved structure, said hopper having a discharge opening communicating with said hopper interior; and a slip form mold connected to said hopper defining a slip form mold interior and a slip form mold exit opening communicating with said slip form mold interior, said slip form mold interior being in communication with said discharge opening for receiving said material from said hopper, said slip form mold including pivotally connected first and second slip form mold portions;

wherein each of said first and second slip form mold portions has a top wall, side walls attached to said top wall and extending downwardly therefrom and an open bottom defined by said side walls, said open bottom comprising said slip form mold exit opening.

3. The apparatus according to claim 1 wherein said mover means comprises a fluid actuated movable piston connected to said second slip form mold portion.

4. The apparatus according to claim 1 wherein each of said slip form mold portions is substantially straight.

5. The apparatus according to claim 4 wherein said second slip form mold portion is shorter than said first slip form mold portion.

6. Apparatus for alternatively forming either a straight or a curved structure on a surface, said apparatus comprising, in combination:

a vehicle including a hopper defining a hopper interior for accommodating material to be formed into a curved structure, said hopper having a discharge opening communicating with said hopper interior; and a slip form mold connected to said hopper defining a slip form mold interior and a slip form mold exit opening communicating with said slip form mold interior, said slip form mold interior being in communication with said discharge opening for receiving said material from said hopper, said slip form mold including pivotally connected first and second slip form mold portions;

wherein each of said first and second slip form mold portions has a leading end and a trailing end, the leading end of said second slip form mold portion being positioned at the trailing end of said first slip form mold portion, said apparatus including mover means for selectively laterally displacing the trailing end of said second slip form mold portion.

7. The apparatus according to claim 1 wherein said slip form mold is configured to form a curb structure.

8. The apparatus according to claim 2 wherein the open bottom of said second slip form mold portion is disposed higher than the open bottom of said first slip form mold portion to provide clearance facilitating pivotal movement of said second slip form portion relative to said surface.

9. Apparatus for forming either a straight or curved structure on a surface, said apparatus including:

a slip form mold for connection to a moveable hopper to receive material from said hopper to form either a straight or curved structure during movement of said slip form mold, said slip form mold defining a slip form mold interior and a slip form mold exit opening communicating with said slip form mold interior, said slip form mold including first and second slip form mold portions pivotally connected to one another and having adjacent ends; and mover means for selectively pivoting said second slip form mold portion relative to said first slip form mold portion whereby a trailing end of said second slip form mold portion is laterally displaced relative to said first slip form mold portion.

* * * * *